US009161582B2

(12) United States Patent
Anderson

(10) Patent No.: US 9,161,582 B2
(45) Date of Patent: Oct. 20, 2015

(54) LINKED BELT

(71) Applicant: Paul Anderson, San Diego, CA (US)

(72) Inventor: Paul Anderson, San Diego, CA (US)

( * ) Notice: Subject to any disclaimer, the term of this patent is extended or adjusted under 35 U.S.C. 154(b) by 0 days.

(21) Appl. No.: 14/066,576

(22) Filed: Oct. 29, 2013

(65) Prior Publication Data

US 2014/0115756 A1 May 1, 2014

Related U.S. Application Data

(60) Provisional application No. 61/719,782, filed on Oct. 29, 2012.

(51) Int. Cl.
*A41F 9/00* (2006.01)

(52) U.S. Cl.
CPC ..... *A41F 9/002* (2013.01)

(58) Field of Classification Search
CPC ..... A41F 9/00; A41F 9/002; A41F 9/007; A44C 5/02; A44C 5/102; A44C 5/105; A44C 5/107; A44C 5/08
USPC ..... 2/338–340; 59/80, 84, 85, 88, 89, 82
See application file for complete search history.

(56) References Cited

U.S. PATENT DOCUMENTS 689,764 A * 12/1901 Titus ..... 59/78
767,941 A * 8/1904 Hartung ..... 2/339
1,065,006 A * 6/1913 Sommer ..... 59/80
1,152,477 A * 9/1915 Bizby ..... 474/227
1,720,235 A * 7/1929 Prestinari ..... 59/80
1,751,792 A * 3/1930 Carlson ..... 59/80
1,787,405 A * 12/1930 Dansereau ..... 59/80
1,792,158 A * 2/1931 Gleckner ..... 2/322
1,836,955 A * 12/1931 Carlson ..... 63/5.1
1,847,182 A * 3/1932 Heyer ..... 2/322
2,009,157 A * 7/1935 Zilles et al. ..... 198/850
D141,170 S * 5/1945 Braunstein ..... D11/12
2,451,397 A * 10/1948 Marquardt ..... 2/338
2,505,169 A * 4/1950 Bikoff ..... 59/80
2,539,891 A * 1/1951 Carr et al. ..... 2/339
3,837,163 A * 9/1974 Fujimori ..... 59/80
3,976,233 A * 8/1976 Cobelli ..... 224/164
4,639,948 A * 2/1987 Adell ..... 2/338
4,642,982 A * 2/1987 Gray ..... 59/35.1
5,515,550 A * 5/1996 Friedman et al. ..... 2/338
D374,111 S * 10/1996 Wilson ..... D2/633
6,101,842 A * 8/2000 Delacretaz ..... 63/4
6,272,836 B1 * 8/2001 Fat ..... 59/80
6,328,188 B1 * 12/2001 Boznos et al. ..... 224/175
6,406,177 B1 * 6/2002 Fukushima et al. ..... 368/281
6,418,706 B1 * 7/2002 Kit ..... 59/80
6,622,469 B2 * 9/2003 Gunster et al. ..... 59/80
6,913,411 B2 * 7/2005 Yamakawa et al. ..... 403/154
7,146,793 B1 * 12/2006 Hyun ..... 59/80
D680,708 S * 4/2013 Kosh ..... D2/639
2005/0150034 A1 * 7/2005 Marks ..... 2/338
2007/0294807 A1 * 12/2007 Van Cotthem ..... 2/321

* cited by examiner

*Primary Examiner* — Danny Worrell
(74) *Attorney, Agent, or Firm* — Donn K. Harms

(57) ABSTRACT

A device enabling the formation of a belt or suspenders through a sequential engagement of a plurality of removably engageable bodies. The bodies are only engageable and disengageable when positioned at an engagement position substantially perpendicular to adjacent bodies.

11 Claims, 7 Drawing Sheets

LINKED BELT

BACKGROUND OF THE INVENTION

1. Field of the Invention

This application claims priority to U.S. Provisional Patent Application Ser. No. 61/719782 filed on Oct. 29, 2012 and which is included herein in its entirety by this reference thereto.

The present invention relates to belts conventionally employed for garments and the like. More particularly, it relates to a belt formable by employing a plurality of belt link components configured to engage with each other to form a continuous belt, suspender, or similar structure. The links are formed to render them removable engageable to adjacent loops in the formed belt as a means for adjusting the overall length of the belt. The links may additionally include indicia disposed on at least one surface, such as alphanumeric characters, images or the like providing a means to display words or symbols using incremental connections of individual link components. Employing indica the device provides for a goal oriented system with incremental rewards such as for encouraging weight loss through belt link awards for achievement or as a teaching aid.

2. Prior Art

Belts and suspenders are functional clothing for the support of pants or encirclement of other clothing being worn by the wearer. Depending on their configuration, belts and suspenders can be low-key or can provide both a fashion statement as well as accomplishing their support function. For example belts and suspenders may be configured to blend in with the supported clothing, or they may be decorated to lean toward high fashion such as having expensive leather, adorned jewelry, and extravagant custom buckles. In either case, many users and consumers will enjoy the use of such an accessory which they can uniquely call their own.

Prior art has shown many attempts to provide unique belts. U.S. Pat. No. 2,451,397 to Marquardt teaches an apparel belt or chain formed of a plurality of ornamental chainlike components intended to be assembled to form the complete article. U.S. Pat. No. 4,642,982 to Gray teaches a chain belt formed of a plurality of wires joining tube components formed in a fashionable manner. US Pub. No. 2007/0294807A1 to Van Cotthem teaches a segmented belt assembly formed of band segments that can be interchanged to form to a particular circumference.

However, these and similar belt like devices merely provide decorative elements upon the overall formed belt or suspenders and fails to otherwise provide any additional useful function.

As such there is a continuing and unmet need for a belt or a similar accessory device formed of a plurality of engaged incremental components, which allow for customization of size and decoration. Further, a belt or suspender type device which would cure some of the shortcomings of prior art should not only provide the user means for customization, such a device should also provide an especially secure means of engagement of the individual inks or belt components so as to provide utility and a secure means to support clothing on the user.

In addition to allowing some users the ability to form customized belts and suspenders which are fashionable, an additional aspect of the device should advantageously provide an incremental system of encouraging achievement through the provision of indicia on individual belt links to encourage users toward an ultimate goal such as providing encouragement for weight loss which is directly related to the ultimate length of the formed belt or suspenders. Such a device, so formed of a plurality of interlocking and interchangeable link components, should provide a user with a means for visibly affirming their success in their weight loss progress, not only with a shorter belt, but with indicia recognizable to memorialize reaching particular levels of success.

The forgoing examples of related art and limitation related therewith, and the noted need for a relief in the art of such shortcomings, are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device and method herein disclosed and described provides a solution to the shortcomings in prior art of assembled belts and suspenders and achieves the above noted goals through the provision of a belt or suspender apparel device which is user-configurable. In one preferred mode the device is formed of a plurality of individual link components, from a kit of link components, each configured to engage adjacent link components and so engaged to form a continuous belt or chain or strap or suspender wearable by the user. The link components may be molded, extruded or otherwise formed into individual components from one or a plurality of materials from a group including plastic, metal, polymeric materials, hybrid materials such as carbon fiber, or other formable materials adapted to be rendered to the configuration of the individual links or belt component sections herein. Preferably the sections or components forming the belt or suspender or the like, are substantially planar on at least one side surface and are configured with a first end and a second end and include at the first end a first engagement means and at the second end a second engagement means which is complimentary to the first. In this fashion each first end of each body section forming the belt, is engageable with each second end of an adjacent section or link.

In the system herein, a plurality of individual bodies defining link components is made available, and each of the plurality of link components has first and second end configurations which are substantially identical and are removable engageable end-to-end such that the first engagement means of the first end of one link can be removably engaged to the complimentary second engagement means of the second end of another link component. The plurality of link components can be so engaged to form any length belt, wherein ultimately the distal ends of the desired length can themselves be engaged to form the continuous loop defining the belt or may be engaged with other means for linking the two ends of the formed belt. Individual link components can then be added or removed to vary the size of the belt as needed. In all modes of the device and method, a buckle and belt end can also be configured for engagement to the two ends of the formed belt.

In yet another mode of the present invention, the device may include fabric or other material band element much like a conventional belt and operatively engaged using individual link components to define the belt apparel device. The band may be formed of a substantial length as to provide the majority of the circumference while the link components may be employed in limited number providing a limited range of length adjustment. In this aspect the band may be formed of leather or other material, such as at the buckle end and/or in side sections, to provide a look that is relevant to high fashion attire or formalwear while the link components of the instant invention provide means for length adjustment, and customization. Therefor, users who enjoy leather, or canvas or other materials, are able to continue to employ such as material while still being provided with the novel device and method of the present invention. In aspects of this mode of the device, the link components may essentially replace the conventional buckle, or alternatively may be employed in combination with a buckle.

In still another mode of the present invention, the device may include one or a plurality of link components engaged to a living hinge or other flexible member. Since the body forming each of the link components is preferable as a rigid structure, the provision of a flexible member communicating between two or more link components provide a means for flexing or bending with the movement of the wearer as needed for comfort and fit.

In accordance with the preferred modes of the device, the present invention provides a unique and novel method for weight loss measurement and encouragement. Conventionally, those aiming to lose weight may not notice substantial changes in their appearance til after a substantial amount of weight is lost, which may take quite a bit of time. Further, without daily or weekly encouragement or affirmation, many users may not make it through a complete weightless program because they are discouraged and feel as if they are making no progress.

Therefor, in one preferred aspect of the method the individual links may be formed of a specified length, for instance inch or 1 inch. As a user loses weight and girth around their waist, the belt loop will be shortened and the user will know exactly how much they lost by the length or number of colors of the links removed. The loops removed may be colorized such that when all of one color is removed, a goal is achieved or indicia may be on some links or replacement links given as the belt is shortened which have indicia thereon. The user, and others in the same class or system using the belts, are provided with instant visual affirmation and are further able to set goals based on link removal.

As such, the links may include indicia indicating the length is shortening such as different color links being removed from those remaining or some other visual means to show removed links. Further, the user can be provided with indicia to replace some of the removed links which may include positive affirmation indicia such as a smiley face or text reading "You did it!" or "Keep up the good work!"

In another preferred mode of the device, the link component having a front surface and a rear surface may include other forms of indicia or a color imparted on one or both surfaces. The user may be provided with a plurality of link components in a kit having alphanumeric characters on the front surface. The user can then link the components in a manner to spell a name, or write a phrase. Parents or teachers may use the device as a fun and interactive teaching tool for teaching spelling, grammar, and the like. For example, the children can use the device to spell their name, favorite color, etc. Other forms of indicia that can be applied to either surface include numbers, designs, colors, logos, school mascots, or other symbols such as Greek letters for a fraternity for example.

In yet another mode, the link component may include a shaped aperture communicating through at least one of the front or rear surface, and an operatively shaped insert for engagement into the aperture. For example, the aperture may be formed to resemble the letter "A" and with that there may be included a color insert also resembling the letter A and formed to snugly fit into the complimentary aperture. In still another mode the surface of the link component may be formed with a slot for receiving a planar member having indicia imparted on it. The planar member may have alphanumeric characters, colors, or the like such that the user can place the desired planar members in the link components in a sequence to similarly spell a name or write a phrase. In this mode the use may be provided with a kit 63 of such planar members allowing the user to replace the members as desired. Further in this mode the device may include an extra wide, or extra large, body forming the link component having a compartment to hold the kit of planar members.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the invention to provide a belt apparel device formed from a plurality of link components which are removably engageable rendering the belt abusable.

It is a further object of the invention to provide a belt or suspender apparel supporting device formed from a plurality of link components and which may also engage with conventional belt material.

It is another object of the invention to provide a belt apparel device formed from a plurality of link components wherein some components are linked by a living hinge or other flexible member.

It is still another object of the invention to provide a weight loss encouragement method employing a belt apparel device formed from a plurality of removably engaged link components such that individual components are removed as weight is lost and provide positive visual affirmation.

These and other objects, features, and advantages of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
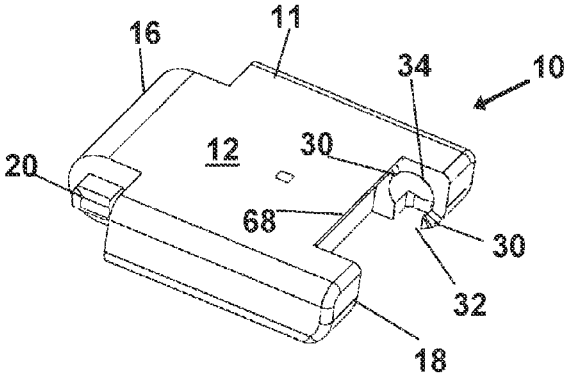
FIG. 1 shows a first perspective view of an individual link component of the present invention.
Figure 2:
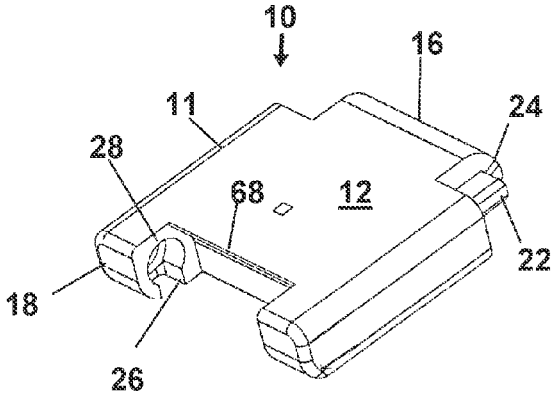
FIG. 2 shows a second perspective view of the individual link component.

Now referring to drawings in FIGS. 1-32, wherein similar components are identified by like reference numerals, there is seen in FIG. 1 and FIG. 2 perspective views of the link engageable to similarly formed link device 10 to form a belt or strap such as for supporting clothing. The device 10 has a body 11 shown formed as substantially a rectangle, however other shapes such as circles, ovals, octagons, pentagons, stars, are employable as long as the two opposing connectable side edges are included in the body 11. The body 11 is a unitary structure formed of a suitable material such as polymeric materials, plastics or metals or hybrid materials such as carbon and resin. The device 10 may be formed by any conventional means known in the art such as injection molding or casting or machining whereby the opposing cooperatively engageable edges are formed.

The body 11 is defined by a front surface 12, rear surface (FIG. 4), a first end 16 and a second end 18. Opposing side edges 17 communicate between the first end 16 and second end 18. The first end 16 and a second end 18 respectively include a first means of engagement and a second means of engagement, with the second means of engagement being complimentary and removably engageable to the first means of engagement.

In use a plurality of such link component devices 10 may be engaged end-to-end employing complimentary means for engagement of the first end to the second end sequentially. In the mode of the device shown herein, means for complimentary engagement of the first end to the second end of an adjacent body 11 is shown generally as a 'slot and tab' style complimentary engagement of projecting members within slots or apertures forming a circular race thereby yielding an operatively engaged plurality of link component bodies 11 engaged in respective pivotal engagements end-to-end forming an elongated flexible member or a continuous loop or belt.

Figure 3:
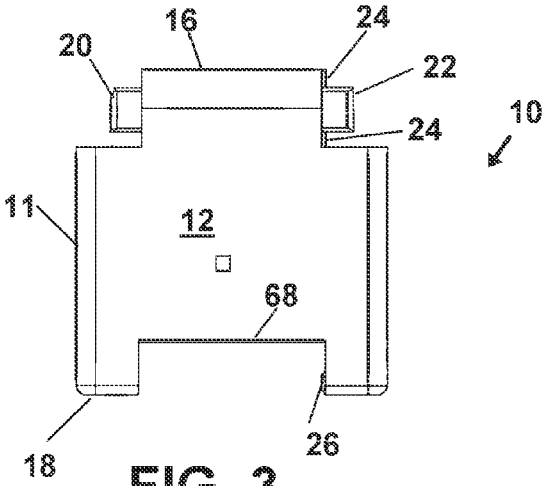
FIG. 3 is a view of the front surface of the link component.
Figure 4:
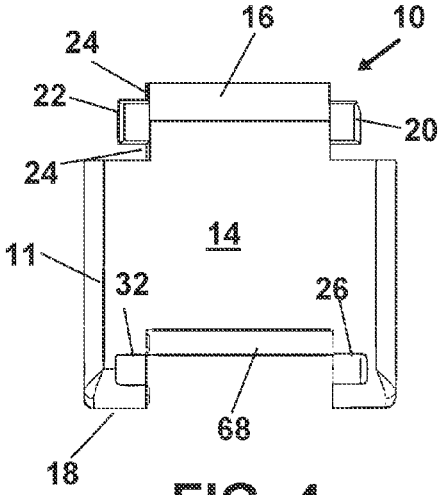
FIG. 4 is a view of the rear surface of the link component.
Figure 5:
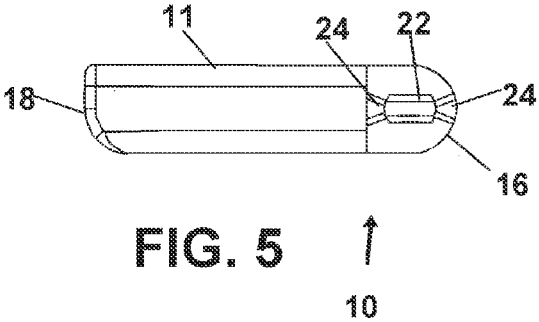
FIG. 5 shows a first side view of link component.

As can be seen further in the top and bottom views of FIG. 3 and FIG. 4 the first end 16 includes opposing projecting members shown as tabs 20, namely, a first tab 20 and an opposing projecting second tab 22. In accordance with the complementary means of engagement, the second end 18 includes a first slot 26 and a second slot 32 configured as circular races for receiving the tabs 20, 22 of the first end 16 of another link component 10 in operative engagement (shown later in FIG. 7). The slots 26, 32 communicate with respective substantially circular cavities 28, 34 which allow the operatively engaged additional link component tabs 20 and 22 to rotate within the cavities 28, 34 as the long diameter of members forming the tabs 20 and 22 is equal to or slightly smaller than the respective circular diameter of the cavities 28 and 34 configured for engagement of the projecting tabs 20 and 22.

Figure 6:
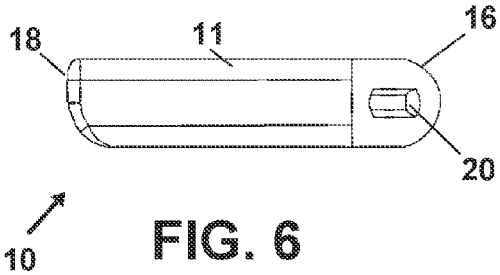
FIG. 6 shows a second side view of the link component.

In one preferred mode, a plurality of link components 10 may be assembled to form a continuous loop such as a belt. Due to the jarring motions the body 11 of the device 10 may encounter it is of advantage to ensure the individual bodies 11 forming the links, do not inadvertently disengage from one another. As such there can be seen protruding members 24, 30 positioned about the periphery of base of the second tab 22 and second cavity 30. Once the plurality of components 10 are operatively engaged end-to-end, the respective protruding members 24 act as rotation limiters by impeding the rotation of the engaged first and second ends of adjacent link bodies 11 past a predetermined angle such that the bodies 11 forming the links cannot disengage. This is shown in more detail in later figures and in FIG. 5 which shows a side view better depicting the protruding members 24 about the second tab 22. FIG. 6 shows an opposite side view of the device 10.

Figure 7:
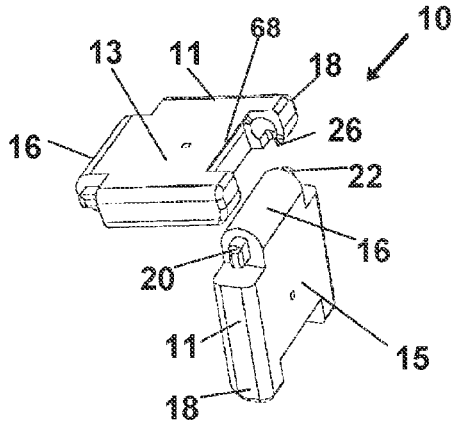
FIG. 7 is a perspective view of two link components prior to engagement.
Figure 8:
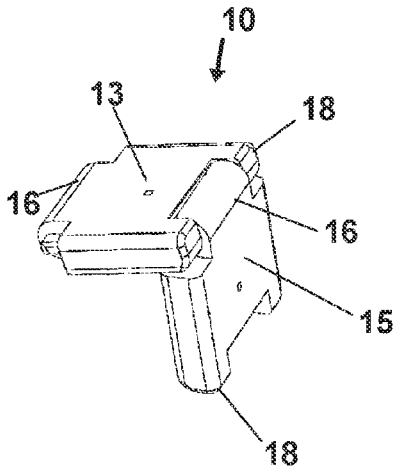
FIG. 8 is a perspective view of the two link components operatively engaged.

FIG. 7 depicts adjacent link component bodies 11 shown as a first link component 13 and a second link component 15 prior to operative rotational engagement. As can be seen the bodies 11 forming each of the first and second components 13, 15 are positioned at a substantially 90 degree angle as to orient the tabs 20, 22 of the second component 15 inline with the slots 26, 32 of the first component 13. As depicted, the tabs 20, 22 are shaped with parallel planar sides distanced sufficient to translate through the slots 36, 32 in only one orientation, namely the substantially 90 degree angle as shown, the devices being securely engage in all other rotation positions. FIG. 8 shows the link components 13, 15 engaged such that the tabs 20, 22, rotate on their opposing circular edges within the respective cavities 28, 34, herein permitting relative rotation of the two components 13, 15.

Figure 9:
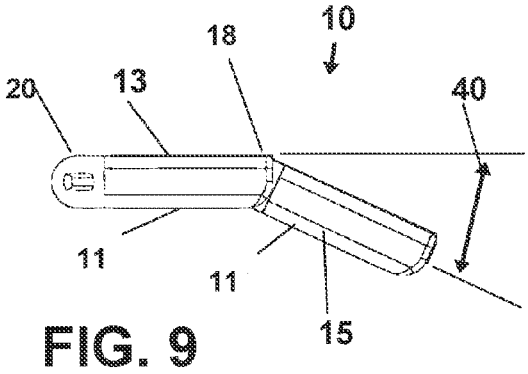
FIG. 9 is a side view of two engaged link components in a first rotational position.

Shown in FIG. 9, the body 11 forming the second component 15 is positioned at a first angle 40 relative the body 11 forming the first component 13. This angle 40 is determined by the location of the protrusions 24, 30 on the respective opposing ends of the components acting as a means for limiting the rotation of the respective components from −10 to 80 degrees. This limiting angle assures that the second component 15 does not inadvertently rotate to the 90 degree orientation required for disengagement.

Figure 10:
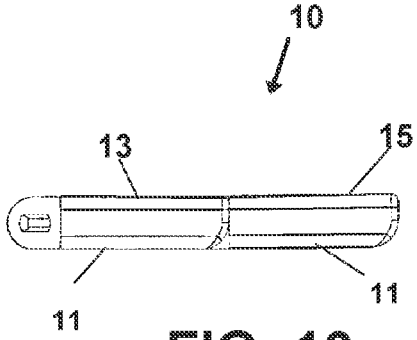
FIG. 10 is a side view of the two engaged link components in a second rotational position.

FIG. 10 shows the two bodies 11 forming first and second link components 13 and 15 aligned in a horizontal plane. A curved overhang or lip 68 (FIG. 7) of the second end 18 of the first component 13 contacts a side surface of the second component and provides a means for preventing and over rotation of the engaged components beyond the horizontal. However it is within the scope of the invention that the second component 15 and subsequently engaged components be permitted to over rotate to some degree in order to prevent damage to the device 10.

Figure 11:
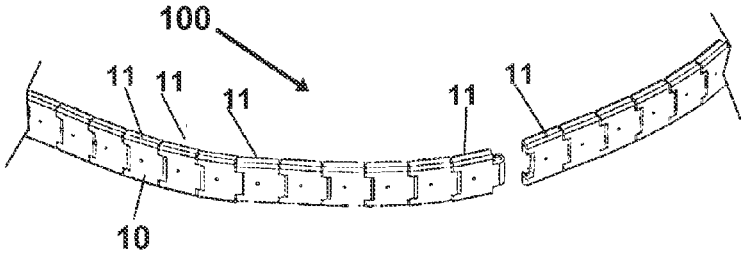
FIG. 11 depicts a first preferred mode of the device showing a plurality of link components operatively engaged to form a continuous belt.

FIG. 11 shows a mode of the device 10 employing a plurality of individual bodies 11 which will extend out to form a continuous loop 100 such as a belt, band, chain, suspender, or the like. However, due to the complexity and interlocking nature of such a plurality of components as shown, other modes of the device may be preferred. At the distal end of the flexible member shown in FIG. 11, to opposite complementary edges of adjacent bodies 11 can be engaged, or, conventional belt components (FIG. 31) can be engaged to allow a buckle and pin or similar engagement of the distal ends.

Figure 12:
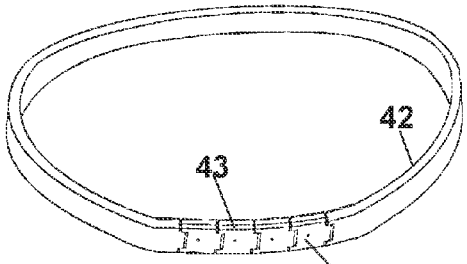
FIG. 12 shows another preferred mode of the device used in combination with a conventional belt strap component.
Figure 13:
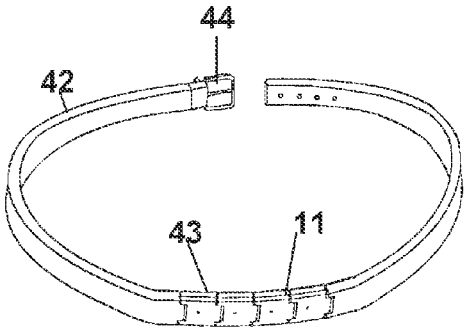
FIG. 13 shows yet another preferred mode of the device used in combination with a conventional belt strap component also having a conventional buckle component.
Figure 21:
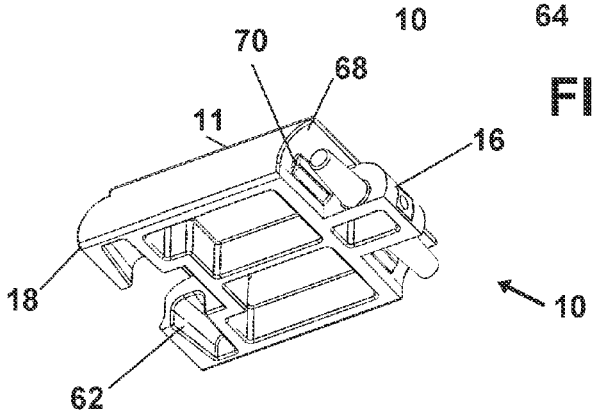
FIG. 21 shows a bottom perspective view of the mode of the device of FIG. 19.

FIG. 12 shows another preferred mode of the device 10 employing a conventional belt strap 42 along with a relatively short band or section 43 of engaged bodies 11. The band 43 may include any number of individual link components formed by individual bodies 11 and should therefor not be considered limited by the four depicted in the figure. FIG. 13 shows yet another preferred mode of the device 10 similar to that of FIG. 12 however additionally employing a conventional buckle component 44. As depicted in FIG. 21, the belt and buckle would each be configured to engage with one of the first or second end of bodies 11 positioned at opposing distal ends of the formed belt.

Figure 14:
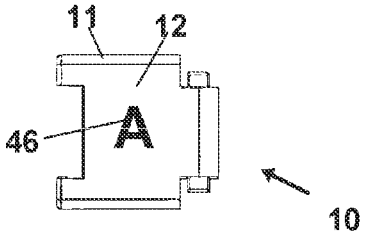
FIG. 14 shows a view depicting a mode of the device having indicia imparted on the front surface.

FIG. 14 shows a preferred mode of the link component 10 having indicia 46 imparted on the front surface 12 of the body 11 of the device 10. The indicia 46 can be an alphanumeric characters, symbols, logos, colors or any other such indicia which is viewable by the user or third parties. The user may be provided with a plurality of link component bodies 11 which have indicia 46 in a kit of bodies 11, for example having alphanumeric characters on the front surface 12. The user can then link the bodies 11 in a sequential manner in the formed belt, to spell a name, write a phrase, or arrange their favorite colors.

Figure 15:
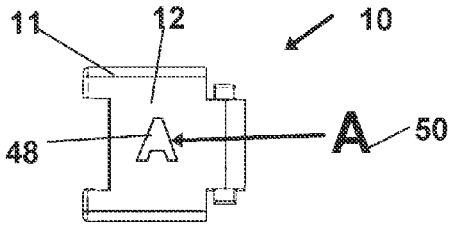
FIG. 15 shows a view depicting another mode of the device having an shaped aperture communicating through the front and rear surface and a complimentary insert.

In yet another mode shown in FIG. 15, the device body 11 includes an aperture 48 communicating at least through one surface 12, 14 and a complimentary shaped insert 50. The insert may be color, formed of another material, or textured to provide a novel means for making the insert 50 stand out. Again the aperture 48 and insert 50 can be of any shape or form such as a symbol, alphanumeric character, logo, or the like.

Figure 16:
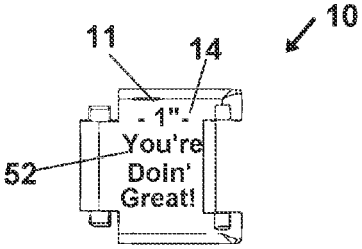
FIG. 16 shows a view depicting yet another mode of the device having uplifting text indicia imparted on the rear surface of the device.

In accordance with a preferred method for employment of the device 10 herein for weight loss encouragement there is shown in FIG. 16 the rear surface 14 of the device 10 having text 52 indicia such as an affirming message and the length of link 10. As the user loses weight, individual links 10 are removed from the belt (such as those described previously in FIGS. 11-13) and the user is provided with an affirming message for encouragement for their weight loss efforts. Or the exposed surfaces of some of the bodies 11 forming the belt may be of a particular color, and removed until all are gone.

Figure 17:
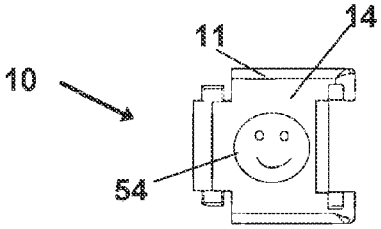
FIG. 17 shows a view depicting still yet another mode of the device having an encouraging symbol imparted on the rear surface of the device.

In another mode, the indicia, in the form of color or letters or a message 52 may be placed on the rear surface 14 as the user will not receive the message until weight is lost and the link is removed. FIG. 17 shows still another mode wherein an affirming symbol 54 such as a smiley face is imparted on the rear surface 14. However such a symbol may similarly be imparted on the front surface 12.

Figure 18:
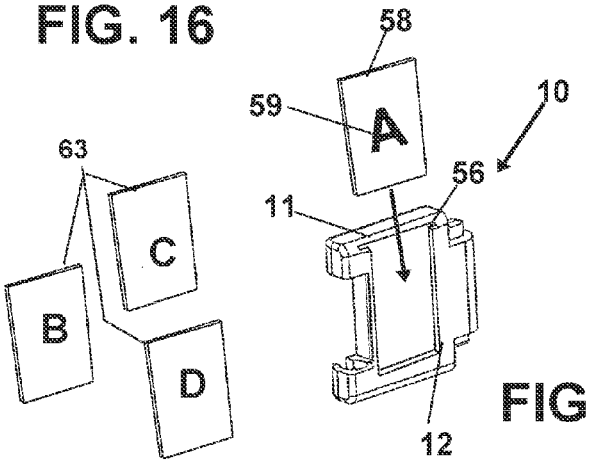
FIG. 18 shows yet another mode of the device having a slot formed on the front surface intended to receive a planar member having indicia imparted on it.
Figure 19:
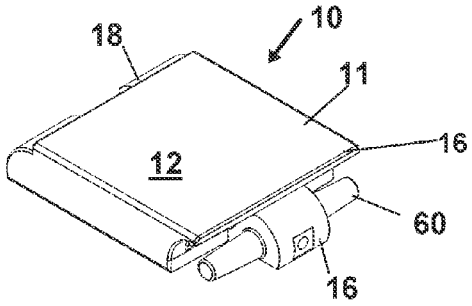
FIG. 19 shows a first top perspective view of yet another particularly preferred mode of the device.
Figure 20:
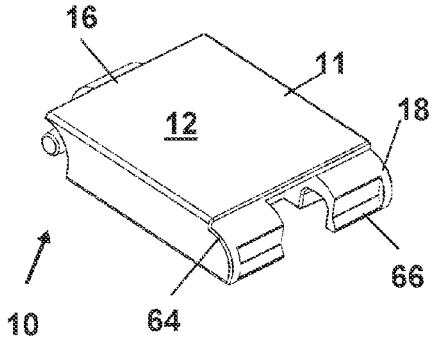
FIG. 20 shows a second top perspective view of the mode of the device of FIG. 19.

A still additional preferred mode of the device 10 is depicted in FIG. 18. In this mode the front surface 12 of body 11 of the device 10 is formed with a slot 56 for removably engaging a planar member 58. A planar member 58 is shown having indicia 59 imparted on a surface. Again, the indicia 59 can be an alphanumeric character, symbol, logo, color or any other such display indicia. The user may be provided with a plurality of planar members having indicia 46 in a kit 63 of planar members 59, for example having alphanumeric characters. The user can then place the planar members 58 in a sequential manner to spell a name, write a phrase, or arrange their favorite colors. This mode may be especially preferred as a teaching aid or game for young children. Teachers can provide young students with the device 10 and plurality of planar members 58 such as the kit 63 with different alphanumeric characters for spelling lessons and the like. While shown with three members and letters, the kit 63 may have an infinite number of members with any type of indicator thereon.

Figure 22:
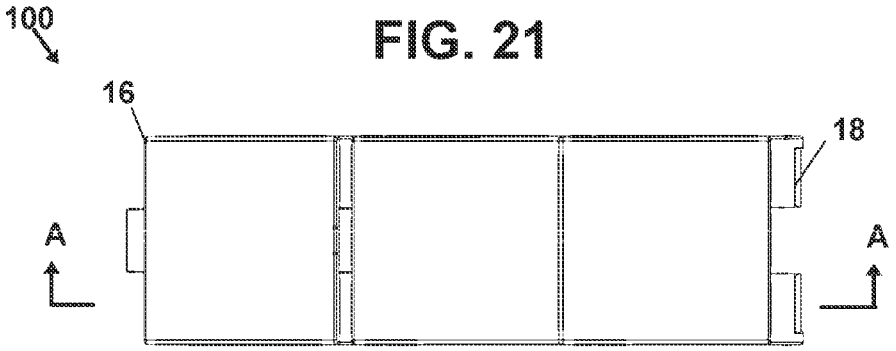
FIG. 22 shows a top view depicting the device of FIG. 19 forming a continuous chain.
Figure 23:
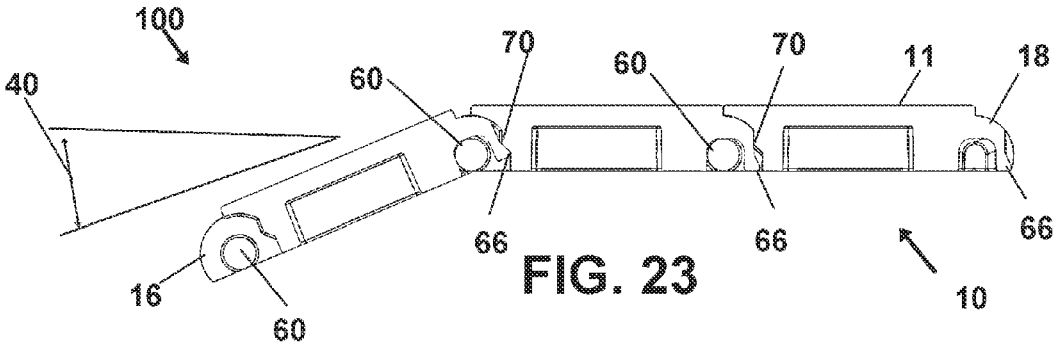
FIG. 23 shows a side cross sectional view depicting the mode of the device of FIG. 19 forming a continuous chain, shown from line AA of FIG. 22.

FIG. 19-23 shows yet additional preferred modes of the device 10. In this mode the first end 16 of the device 10 employs two opposing projecting substantially frustoconical or tapering engagement tabs 60. Further, the second end 18 of the body 11 employs a complimentary tapered tab receiving cavity 62 for operatively engaging any of a plurality of the bodies 11 of the device 10, end to end as shown in FIGS. 22 and 23 to form a chain or band 100.

Similar to previous mode, the tabs 60 and cavity 62 are configured such that adjacent individual devices 10 can only be initially engaged when oriented at an angle of about 80-100 degrees relative each other. Means for resisting disengagement of the device 10 from the as-used mode as band, as well as means for limiting rotation of the device 10 when engaged to one another are provided.

A curved surface overhang or lip 68 adjacent the tabs 60 is provided and employs one or a plurality of protrusions 70, which, when rotating the device 10 into the as used position forming the band 100, will engage a second one or plurality of protrusions 66 disposed on the exterior curved surface 64 provided at the second end 18 of the device 10. When rotated further, the communication of one protrusion 66 over the other 70 in a cam action which will cause the device to slightly deflect until it is cleared. The deflection preferably occurs in the frustoconical tabs 60, wherein the tabs 60 themselves slightly flex within the cavity 62 as the protrusions 66, 70 are communicated over one another. It is noted that the cross section and/or material properties of the tabs 60 and therefor the flexibility of the tabs 60 as well as the allowed clearance within the cavity 62 can selectively adjusted by the designer to determine the amount of force required to communicate one tab 66 over the other 70.

Shown in FIG. 23, each of the operatively engaged devices 10 forming the band 10 are limited to a preferred range of rotation shown by angle 40. Again, this angle can be between 0 and 80 degrees, however it is noted that a values outside of this range may be employed and are anticipated.

Figure 24:
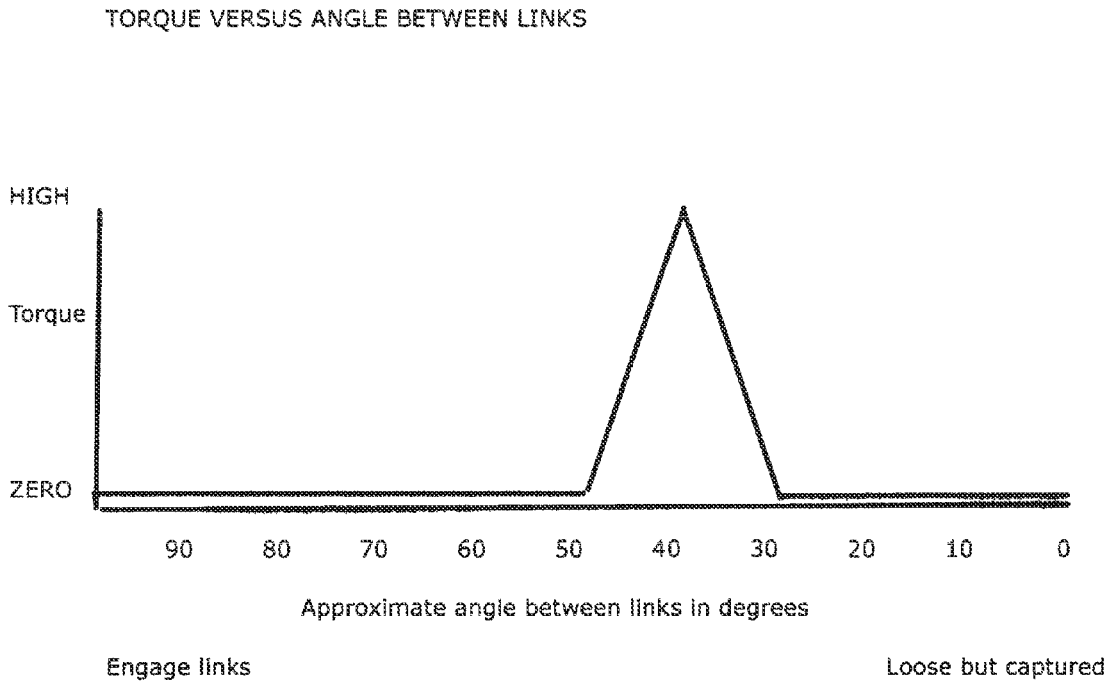
FIG. 24 shows a plot of relative torque required to rotated engaged links versus the angle between them.

For example, FIG. 24 shows a plot of torque required to rotate the engaged devices 10 versus the relative angle 40 between them. As can be discerned from the plot, adjacent likes will be engaged when disposed at about a 90 degree relative angle, and can freely rotated until the protrusions 66, 70 engage at about a 50 degree angle. At this point the user must communicate the protrusions 66, 70 over each other which requires a substantial amount of torque as shown by the spike in the graph. Finally, as interpreted by the graph, adjacent links will have about a 30 degree as used working range of rotation.

In addition, the cross sectional shape of the protrusions 66, 70 can be modified such that it is easier to engage adjacent devices 10 into the as used mode but requires substantial torque to rotate them to the 90 degree disengageable position. In reference to the plot of FIG. 23, such modifications will vary the maximum value at the top of the spike as well as slope of the spike shown in the graph.

Figure 25:
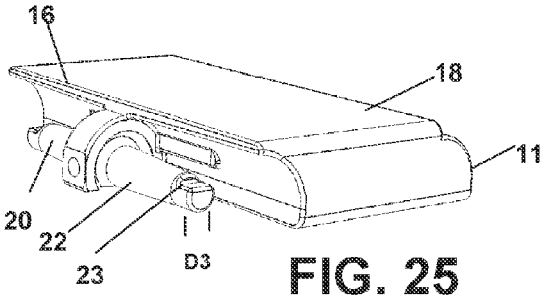
FIG. 25 depicts an especially preferred mode of the device having opposing engagement configurations which only disengage when substantially perpendicular to each other.
Figure 29:
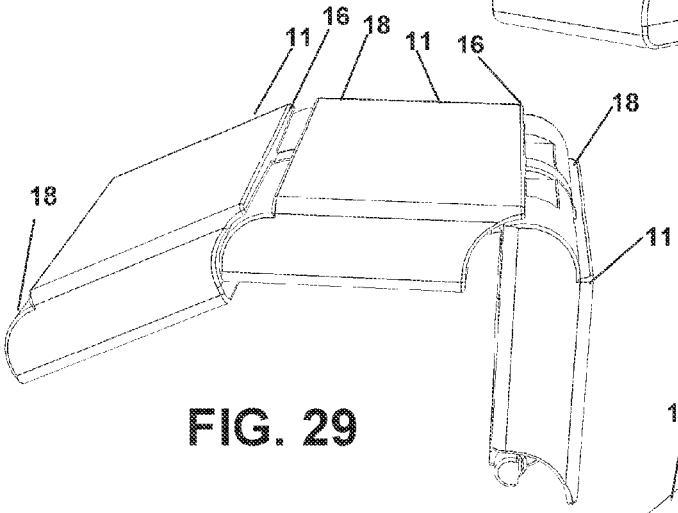
FIG. 29 depicts the required substantially perpendicular angle required for engagement and disengagement of two sides.
Figure 30:
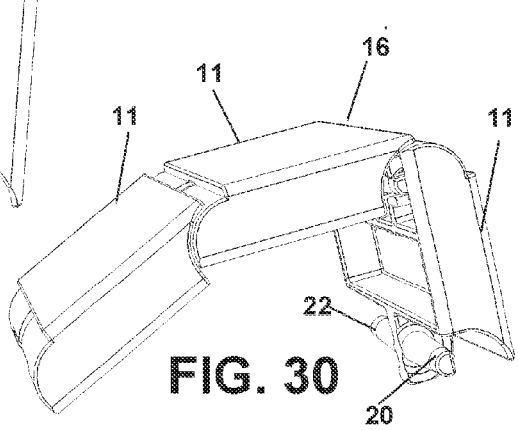
FIG. 30 shows a bottom angled view of two components engaged at an engagement angle where engagement or disengagement is of the tap with the slot is possible.

FIG. 25 depicts an especially preferred mode of the device 10 where the bodies 11 having opposing first ends 16 and second ends 18 configured for cooperative pivotal engagement. In this mode of the device 10 the body has extending members in the form of tabs 20 and 22 configured for cooperative engagement through slots 36 and 32, in a manner which will only engage or disengage when the two bodies 11 are positioned and an engagement position, substantially perpendicular to each other such as shown in FIGS. 29 and 30, which positions the tabs 20 and 22 and slots 36 and 32 concurrently at respective engagement angles. By substantially perpendicular is meant the engagement angle of the bodies 11 forming between a 70 and 110 degree angle to each other with an angle of 85 to 95 degrees being particularly preferred since it allows less slippage or disengagement when a plurality of bodies 11 are engaged and extend around a sharp curve such as the side of a waist of an individual which is at a steeper curve then the front or back of their body, or when used as suspenders at the steep angle over the shoulders.

At the distal ends of both projecting members or tabs 20 and 22 are a notch 23 which is defined by a planar surface extending to the circular circumference of the projecting members shown as tabs 20 and 22. The notch defines a diameter D2 (FIG. 26) is sized to traverse through the diameter sized as D1 of the slots 32 and 36 at the opposing end of an adjacent body 11. However, the diameter D3 (FIG. 25) of the members forming tabs 20 and 22 measured across the intersection of the notch with the circumference of the distal end of the tabs 20 and 22, is wider than D1 and D2. Thus, when the tabs 20 and 22 are engaged in the slots 32 and 36, and the two adjacent bodies 11 are parallel, or at an angle where the planar surface of the notch 23 is not perpendicular to the opening of the slots 32 and 36, removal of the tabs 20 and 22 from rotational engagement in the slots 32 and 36, is impossible without deforming or tearing the slots 32 and 36. Thus, forming the notches 23 at the distal ends of the projecting tabs 20 and 22 is especially preferred as a means to prevent removal of the tabs 20 and 22 unintentionally and without assuming the substantially perpendicular positioning of the two adjacent bodies 11. By substantially perpendicular is meant between 80 and 110 degrees offset.

Figure 26:
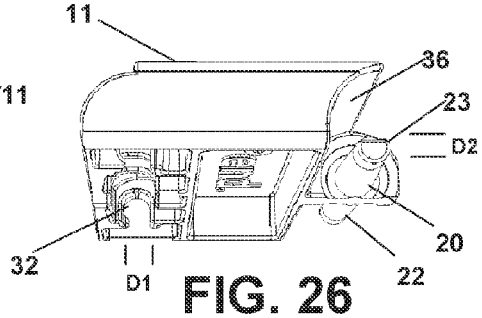
FIG. 26 depicts the engagement components on both edges showing the diameter of one side adapted to allow disengagement of the other, only when at an angle normal to each other.

FIG. 26 depicts the engagement components on both the first and second ends of the body 11 from a perspective view of the bottom of the body 11. As can be seen the slots 32 and 36 have openings sized at D1 which allows the translation of the distal ends of the tabs 20 and 22 therethrough when positioned substantially perpendicular. Also shown in lip 68 which is curved complimentary to the top of the second end 18 of another body 11 if engaged thereto. This curved rotational engagement prevents two engaged bodies 11 from disengaging when struck by force from a traverse angle.

Figure 27:
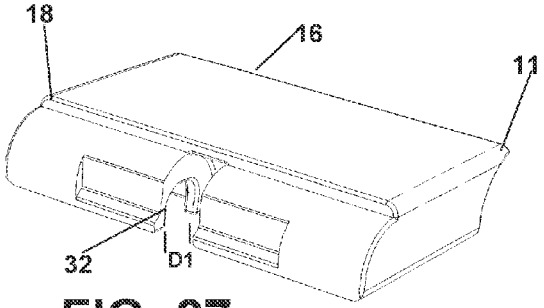
FIG. 27 depicts the opposing edge from that of FIG. 25.

FIG. 27 depicts the opposing edge view from that of FIG. 25 and showing a slot 32 having the diameter D1 of the diameter of the distal end of the tabs 20 and 22 measured from the planar surface at a perpendicular line through the axis of the tabs 20 and 22 to the curved circumference. As noted this only allows engagement and disengagement of the tabs 20 and 22 with the slots when substantially perpendicular thereto.

Figure 28:
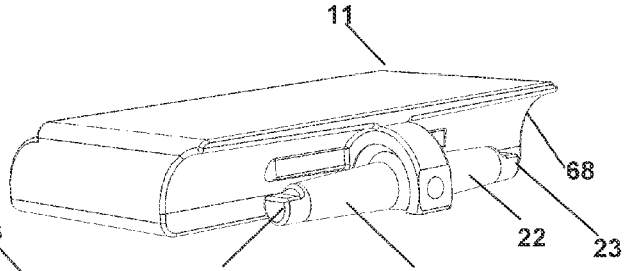
FIG. 28 shows an opposite view from that of FIG. 25 and showing distal end portions having a first and second diameter.

FIG. 28 shows an opposite view from that of FIG. 25 and showing the distal ends of the tabs 20 and 22 having two diameter sizes. FIGS. 29-30 depict the device 10 having three bodies 11 with two in locked engagement and substantially aligned, and the third body 11 in an engagement/disengagement position.

Figure 31:
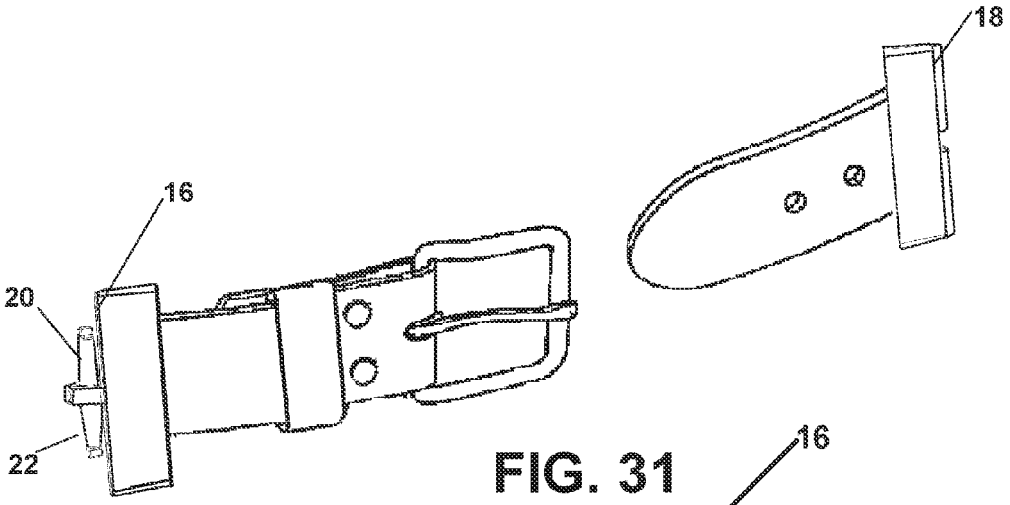
FIG. 31 shows half sections of the individual component engaged to a conventional flexible belt having a buckle.
Figure 32:
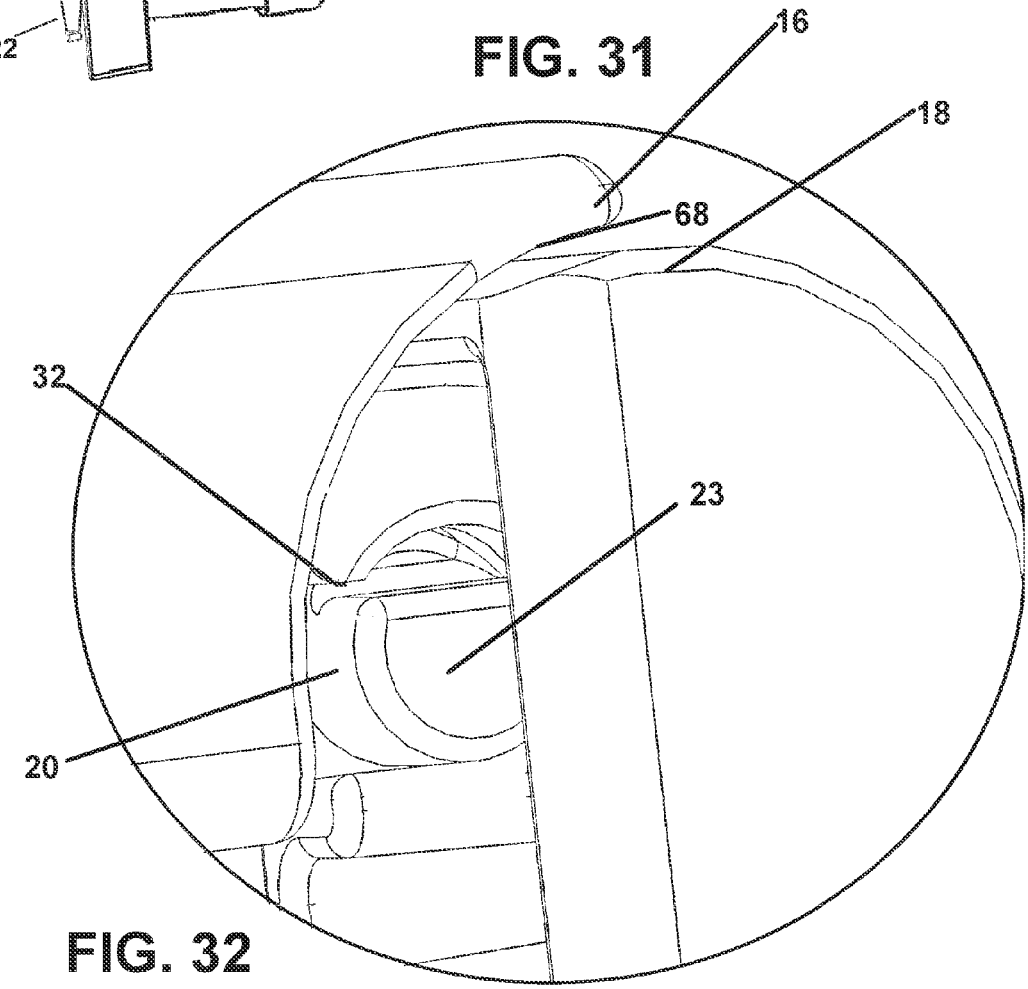
FIG. 32 depicts a blow up sectional view of the engagement of two components of FIG. 30 with the tab and slot at substantially at a perpendicular positioning in an engagement angle, where removal and insertion is possible.

Finally, FIG. 31 shows half sections of an individual body 11, engaged to a conventional flexible belt and buckle section such that they may be engaged to opposing distal ends of a belt formed by a plurality of bodies 11. These can be supplied as part of the kit of components such as bodies 11 so that users may assemble belts which have conventional buckles.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. An apparatus configured for sequential engagement to form a flexible member or belt, comprising:

a body having a front surface opposite a rear surface and having side edges extending therebetween;

said body having a first end opposite a second end;

a pair of members each projecting in opposite directions to respective distal ends from engagements to a. central position at or adjacent said first end of said body;

each of said distal ends having a circumference;

cooperatively shaped slots at or adjacent said second end of said body, said slots configured for insertion of said distal ends of said pair of members to a removable engagement therein at an engagement angle and for a pivotal engagement therein at any other angle other than said engagement angle;

each said body engageable to an additional said body to form an engaged plurality of said bodies, through a positioning of said additional body at an engagement position which concurrently positions said second means of engagement at said engagement angle relative to said first means of engagement;

said distal ends of said pair of members having a relief thereon formed on a first side extending from a portion of said circumference to a wall;

said relief forming a projection having a first diameter extending from a second side opposite said first side of said circumference, to said wall;

said projection having a second diameter extending across said distal end in a direction of said wall, said second diameter being larger than said first diameter;

said slots having an aperture therein extending into a circular race;

said aperture having a diameter equal to or slightly larger than said first diameter;

said projection formed on each said distal end such that said first diameter of said projections on both said distal ends aligns with respective said slots, to allow translation of said distal ends through said slots, only when said bodies are in said engagement position; and whereby said plurality of bodies may be formed into a belt or flexible member formed of said plurality of said bodies each in a respective pivoting engagement with adjacent respective said bodies.

2. The apparatus configured for sequential engagement of claim 1, additionally comprising:

said engagement position being substantially perpendicular.

3. The apparatus configured for sequential engagement of claim 1 wherein said engagement position of said bodies is between a 70 and 110 degree angle relative to each other.

4. The apparatus configured for sequential engagement of claim 2, wherein said engagement position of said bodies is between a 70 and 110 degree angle relative to each other.

5. The apparatus configured for sequential engagement of claim 1, wherein said engagement position of said bodies is between an 85 and 95 degree angle relative to each other.

6. The apparatus configured for sequential engagement of claim 2, wherein said engagement position of said bodies is between an 85 and 95 degree angle relative to each other.

7. The apparatus configured for sequential engagement of claim 1, additionally comprising:

an overhang on said first end of a first said body in a sliding engagement with a relief on a second end of a second said body with said first and second bodies in said pivoting engagement.

8. The apparatus configured for sequential engagement of claim 2, additionally comprising:

an overhang on said first end of a first said body in a sliding engagement with a relief on a second end of a second said body with said first and second bodies in said pivoting engagement.

9. The apparatus configured for sequential engagement of claim 3, additionally comprising:

an overhang on said first end of a first said body in a sliding engagement with a relief on a second end of a second said body with said first and second bodies in said pivoting engagement.

10. The apparatus configured for sequential engagement of claim 4, additionally comprising:

an overhang on said first end of a first said body in a sliding engagement with a relief on a second end of a second said body with said first and second bodies in said pivoting engagement.

11. The apparatus configured for sequential engagement of claim 5, additionally comprising:

an overhang on said first end of a first said body in a sliding engagement with a relief on a second end of a second said body with said first and second bodies in said pivoting engagement.

* * * * *